US005655610A

United States Patent [19]

Skinner

[11] Patent Number: 5,655,610

[45] Date of Patent: Aug. 12, 1997

[54] AUGER CLEANER

[76] Inventor: Todd M. Skinner, P.O. Box 297, Hindsboro, Ill. 61930

[21] Appl. No.: 474,981

[22] Filed: Jun. 7, 1995

[51] Int. Cl.[6] ..... E21B 41/00

[52] U.S. Cl. ..... 175/84; 175/161; 175/209; 175/310; 175/313

[58] Field of Search ..... 175/57, 84, 88, 175/121, 161, 209, 310, 313

[56] References Cited

U.S. PATENT DOCUMENTS

| | | | |
|---|---|---|---|
| 370,810 | 10/1887 | Newman . | |
| 386,901 | 7/1888 | Stanley . | |
| 902,294 | 10/1908 | Hermanns . | |
| 1,220,949 | 3/1917 | Camp | 175/88 X |
| 1,356,125 | 10/1920 | Chattstrom | 175/84 |
| 1,602,375 | 10/1926 | Gibson . | |
| 3,382,935 | 5/1968 | Watts | 175/313 |
| 3,581,833 | 6/1971 | Hennecke et al. | 175/84 |
| 3,817,337 | 6/1974 | Panak et al. | 175/162 |
| 3,968,846 | 7/1976 | Brenner | 175/84 |
| 4,650,012 | 3/1987 | Bollinger et al. | 175/84 |
| 5,067,569 | 11/1991 | Gilcrease | 175/121 X |
| 5,067,570 | 11/1991 | Gilcrease | 175/88 X |
| 5,242,027 | 9/1993 | Blum | 175/84 |

*Primary Examiner*—Roger J. Schoeppel
*Attorney, Agent, or Firm*—Kevin Pontius

[57] ABSTRACT

An apparatus is provided for cleaning dirt and debris from the stem and flighting of an earth boring auger. The auger cleaner apparatus has an opposed pair of blade assemblies which are brought into mechanical engagement with the stem and flighting of the auger. Once the auger cleaner is engaged about the auger, the user of the apparatus then need only rotate the auger cleaner about the auger to strip off dirt and debris. The auger cleaner has handles which provide mechanical advantage to the user for causing the device to rotate about the auger. The device may be provided with selectively exchangeable blade assemblies for adapting the auger cleaner for use on augers of different sizes and of different manufacturers.

15 Claims, 5 Drawing Sheets

AUGER CLEANER

BACKGROUND OF THE INVENTION

1. Field of the Invention

The present invention is generally related to the field of earth boring. More specifically, the present invention is related to the field of methods and devices for cleaning tools used to bore into the earth or other solid or semi-solid matter.

2. The Background Art

Commonly ground boring tools are cleaned manually. Manual cleaning of an auger is performed by hand by a workman wearing gloves as the auger is withdrawn from the bore hole.

Bollinger et al. (U.S. Pat. No. 4,650,012) discloses an apparatus for cleaning dirt and debris from a helical earth boring tool. It has a scraper blade which is mounted on a rotating support which is driven to rotate my a motor. The apparatus is mounted to be freely movable (up and down) along a post.

Hennecke et al. (U.S. Pat. No. 3,581,833) discloses an apparatus for cleaning dirt and debris from a helical earth boring tool. It has opposed wipers which are biased by a spring to move inwardly to engage the boring tool. Both the boring apparatus and the cleaning apparatus are commonly mounted along guide mast.

Blum (U.S. Pat. No. 5,242,027) discloses an apparatus for cleaning dirt and debris from a helical earth boring tool. It has a multi-blade scraper with blades arranged radially. The boring tool and the cleaning apparatus are mutually mounted from the support structure.

Brenner (U.S. Pat. No. 3,968,846) discloses an apparatus for cleaning dirt and debris from a helical earth boring tool. It has a multi-blade scraper with blades arranged radially. Movement of the scraper is actuated by a hydraulic cylinder.

Stanley (U.S. Pat. No. 386,901) discloses a post hole digging apparatus (see FIG. 1) which has a rotary earth boring tool (drill-rod S with a bit at the bottom), and a tool cleaner structure which is fixedly mounted to the frame of the apparatus.

Chattstrom (U.S. Pat. No. 1,356,125) discloses an apparatus for cleaning dirt and debris from a helical earth boring tool. It has a scraper and a handle and it is pivotably mounted to a plate.

Gibson (U.S. Pat. No. 1,602,375) discloses an earth boring apparatus which has a cleaning brush mounted thereon to clean dirt and debris from helical boring tool.

Hermanns (U.S. Pat. No. 902,294) discloses a manual post hole digger which has integrally mounted thereon a cleaning mechanism for forcing accumulated soil from the digger.

Newman (U.S. Pat. No. 370,810) discloses a manual post hole digger which has integrally mounted thereon a cleaning mechanism for forcing accumulated soil from the digger.

Watts (U.S. Pat. No. 3,382,935) discloses an earth boring apparatus which has a helical earth boring tool, a cylindrical casing, and a movable cover member for allowing elimination of dirt from the casing as the tool rotates.

Panak et al. U.S. Pat. No. 3,817,337 discloses an apparatus for making holes in putting greens which has a spring-loaded mechanism for cleaning the soil core from the apparatus.

The conventional devices fail to solve the problem of cleaning dirt and debris from earth boring augers in an easy use and cost-effective manner. The conventional devices are mounted to the digging apparatus as an integral part thereof. Thus, the conventional solutions must be implemented at manufacture of the digging machine, or they must be retro-fitted to the digging machine.

BRIEF SUMMARY OF THE INVENTION

The auger cleaner is a tool for cleaning dirt and debris from the stem and flighting of earth boring augers. The auger cleaner is portable and so may be moved from one job site to another. The auger cleaner is readily adaptable such that it may be exchanged between different digging machines, even ones with different size augers or ones built by different manufacturers.

Most significantly, the auger cleaner makes work easier for the operator of the earth boring machine, or the operators assistants. Rather than cleaning dirt and debris from the auger by hand, the auger cleaner may be fastened about the auger and used to clean the auger with a minimum of effort.

Also of significant advantage, the auger cleaner is small and may be manufactured at a minimal cost. As the auger cleaner is not to be mounted to the earth boring machine as an integral fixture, there is no need for a costly retro-fitting.

It is an object of the present invention to provide an easy way for an operator of an earth boring auger to clean dirt and debris from the auger, which requires less physical exertion than previous methods, such as cleaning by hand.

It is another object of the present invention to provide a cost effective means for earth boring augers to be provided with a cleaning mechanism.

It is another object of the present invention to provide a cleaning tool for an earth boring auger which may be hand held and operable by one person.

It is another object of the present invention to provide a portable cleaning tool for an earth boring auger which may be moved easily from one earth boring machine to another, and thus, exchanged between earth boring machines.

It is another object of the present invention to provide a cleaning tool for an earth boring auger which may be readily modified to fit augers of different sizes and different manufacturers.

Other objects of the present invention will become clear as the invention is described in detail below.

DETAILED DESCRIPTION OF THE INVENTION

Figure 1:
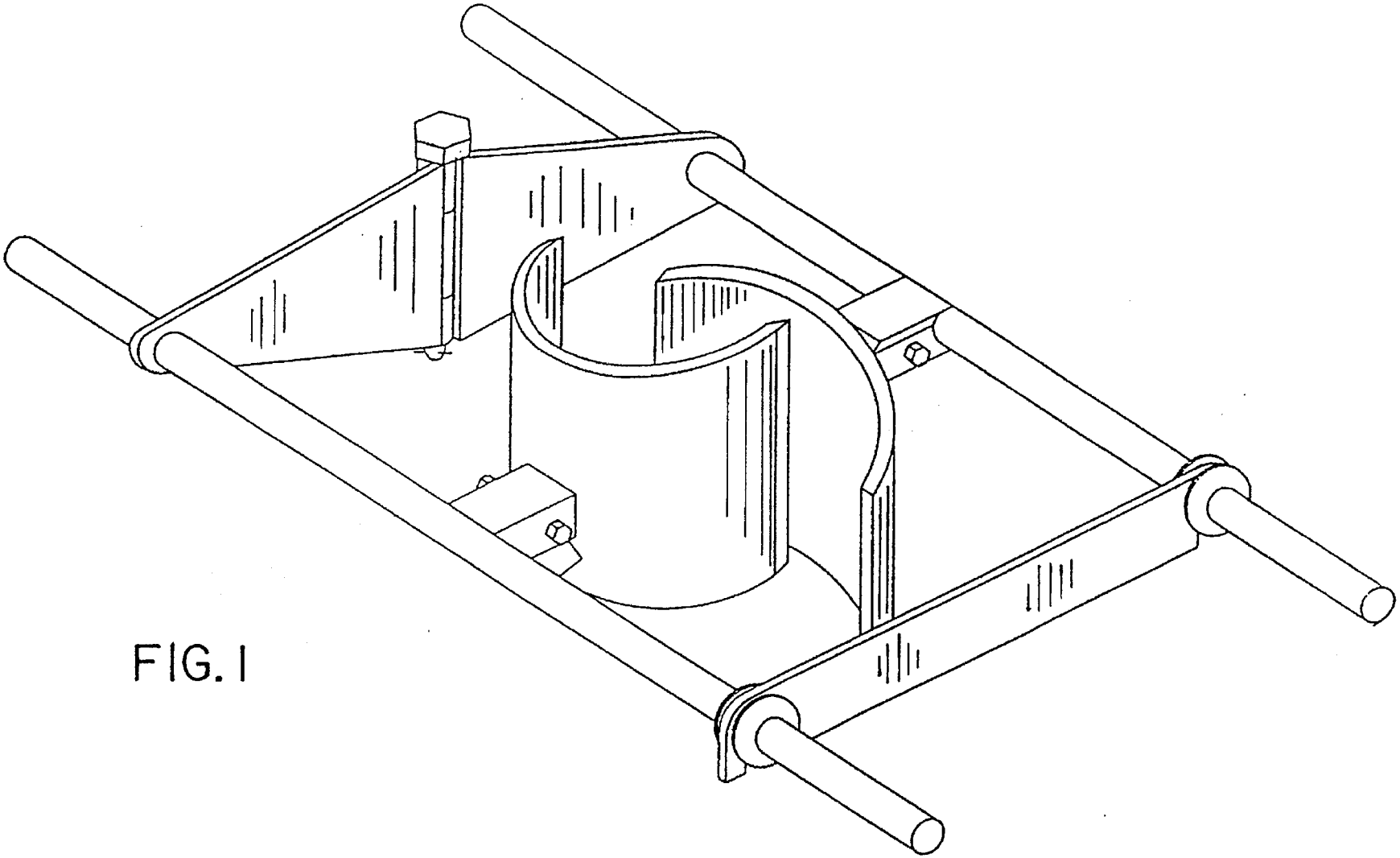
FIG. 1 shows a perspective view of the auger cleaner device according to a preferred embodiment.
Figure 2:
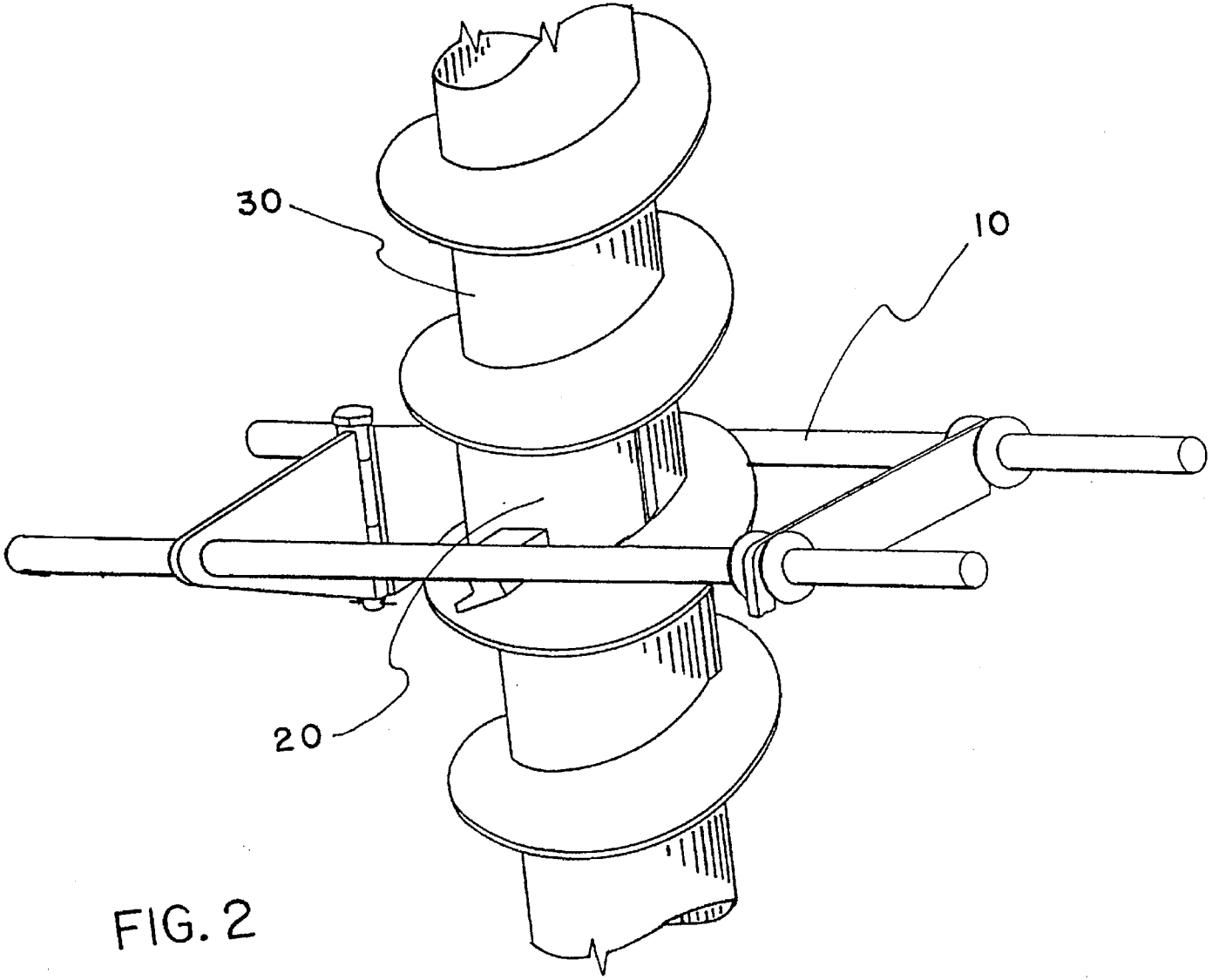
FIG. 2 shows a view of the auger cleaner according to the present invention fastened in an engaged, operating position about an earth boring auger.
Figure 3:
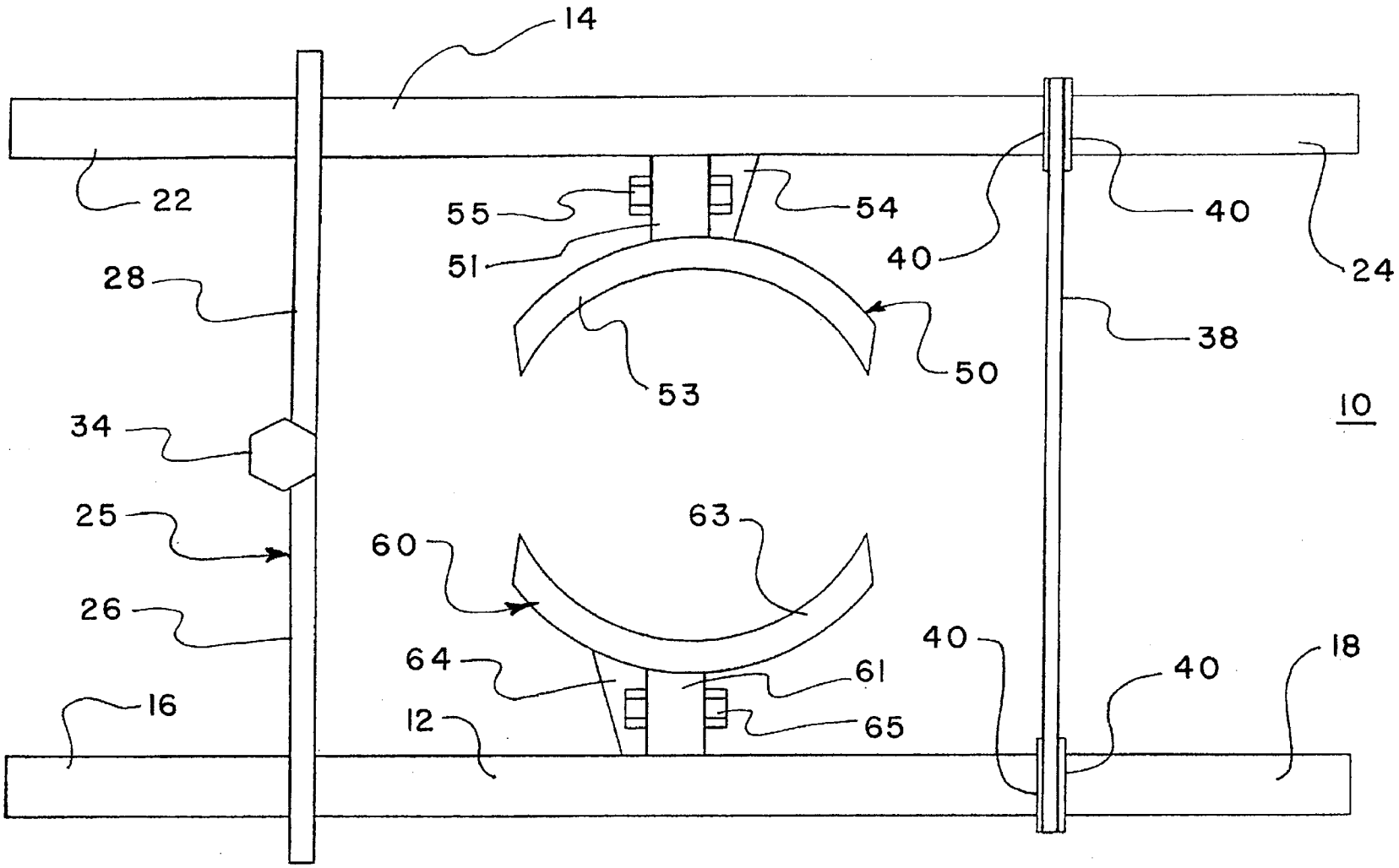
FIG. 3 shows a top view of the auger cleaner device according to a preferred embodiment.
Figure 4:
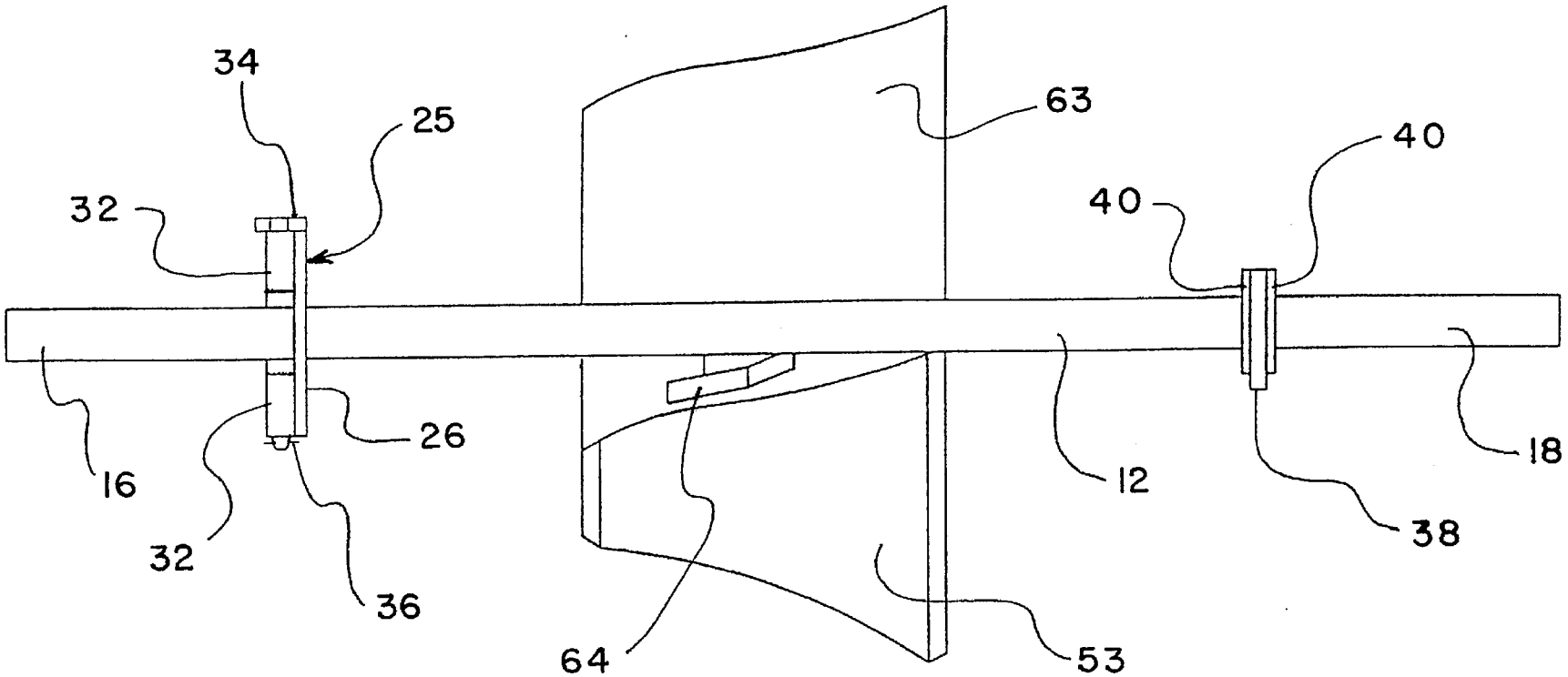
FIG. 4 shows a side view of the auger cleaner device according to a preferred embodiment.
Figure 5:
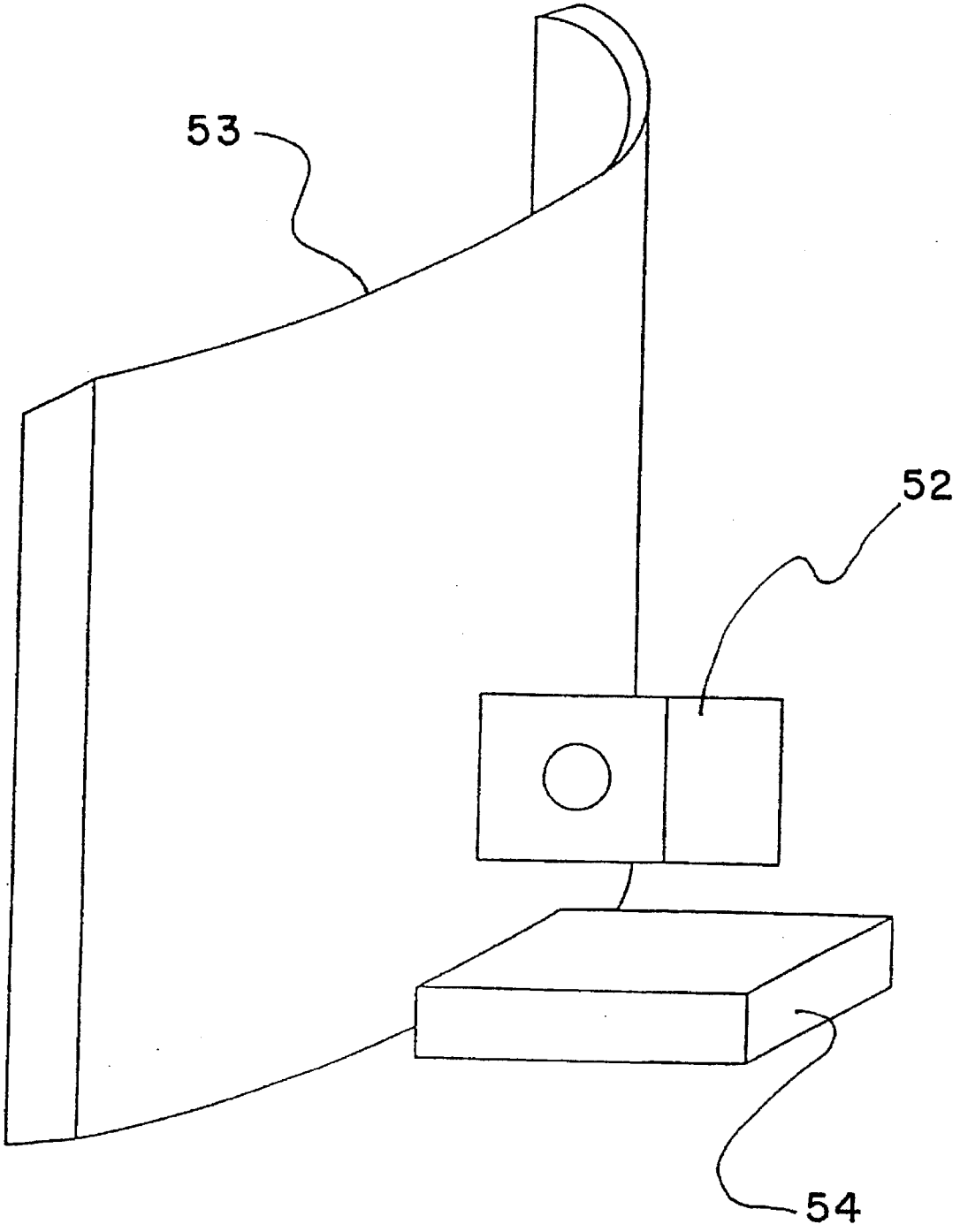
FIG. 5 shows a detail view of one of the exchangeable blade assemblies.

The auger cleaner according to the present invention is simple to use and has a "user friendly" construction. The auger cleaner 10 is a hand tool which secures 20 about an earth boring auger 30. Once the auger cleaner 10 is fastened about the stationary auger 30, the user operates the cleaner by grasping the handles and rotating the cleaner 10 around the auger 30.

The apparatus is composed of four major components: 1) the handles, 2) the hinge, 3) the latch, and 4) the blades.

The handles 12, 14 of the device 10 provide a means for the user to easily grasp the device 10 and to apply force to the device to cause it to rotate about the auger 30 being cleaned. The handles 12, 14 are configured in two separate handle portions which are hinged together. Each of the handle portions may be configured to have one or two hand holds. According to a preferred embodiment, the handles 12, 14 are configured such that each of the two handle portions has two hand holds to form a total of four hand holds 16, 18, 22, 24.

Each of the handles 12, 14 should be formed to be long enough to provide a suitable mechanical advantage to dramatically decrease the amount of effort required to rotate the auger cleaner 10 about the auger 30, as compared to cleaning by hand. As a countervailing consideration, the handles 12, 14 should not be made so long as to collide with the other equipment of the drilling rig (not shown) when the auger cleaner 30 is being used. Accordingly, the handles should have a length which is short enough to operate easily on most rigs having a retractable slide base with out restricting or modifying routine operations.

The handles 12, 14 are spaced in such a way as to be ergonomically correct for a comfortable feel. That is to say, when the auger cleaner 10 is affixed or latched onto the auger 30 to be cleaned, the handles 12, 14 are relatively spaced such that the hand holds 16, 18, 22, 24 may be easily grasped while the cleaner 10 is rotated either clockwise or counter-clockwise during the cleaning process. This allows the operator of the cleaner to easily locate one of the four hand holds 16, 18, 22, 24 (one at each end of each handle) by simply grasping the hand hold with one hand and rotating the cleaner 10 about the auger 30.

The two handles 12, 14 may advantageously be constructed of mild steel, black wall pipe. It is contemplated that schedule 40 pipe may be used for this purpose.

The second component of the device according to the present invention is the hinge 25 which is made up of two hinge plates 26, 28, outer hinge pin housings 32, a hinge pin 34 (or a simple bolt), and a hinge pin retainer pin 36 (or a nut to retain a bolt). There may be either three (shown) or four (not shown) outer hinge pin housings 32. In the case that four hinge pin housings are implemented, the first and second hinge plates 26, 28 are identically constructed to the hinge pin housings 32, and couple together rotatably to form a hinge between the two handle portions 12, 14. The hinge plates 26, 28 are fixed to the handles 12, 14, respectively.

The hinge 25 serves as one of the only two moving parts of the cleaner. The hinge also serves to maintain the proper mechanical tolerances (i.e., cleaning quality) of the device.

The third component of the device according to the present invention is the latch assembly. The latch 38 is the second of the two moving parts of the cleaner. It is simple in design and can be affixed to either of the handle portions 12, 14. Preferably, the latch 38 is disposed just inside the hand holds 18 and 24.

The latch assembly serves as a device to secure the auger cleaner 10 onto the auger 30. The latch 38 is affixed onto one handle 14 opposite the hinge 25 and employs that handle 14 as its pivot point. To prevent the latch 38 from sliding axially along the handle 14 and the handle 12, latch restraints 40 are provided, fastened to the handles 12, 14. The latch 38 is then pivoted on an axis so as to secure or latch onto the other handle 12 at the hand hold 24 opposite of the hinge 25. The latch assembly also serves as a mechanism that helps control the mechanical tolerance between the auger cleaner 10 and the auger 30, resulting in better cleaning quality.

Each end of the latch 38 is constructed with a notch in such a way as to be identical to one other. During assembly one end of the latch 38 is modified through bending so as to permanently affix the latch 38 to the handle 14 in a rotatable relationship. The bending of the end of the latch 38 may be done via cold bending or heated bending.

The auger cleaner 10 has a pair of opposedly mounted blade assemblies 50, 60, each of which is mounted from one of the handle portions 12, 14, respectively. According to a preferred embodiment, the blade assemblies 50, 60 are removably mounted onto the handles 12, 14. Each blade set along with its associated mounting hardware form a blade assembly.

A blade assembly 50 is composed of the blade holder or socket 51, the socket-to-blade connecting shaft 52, the tube blade 53 (or stem blade), the flighting blade 54, and the blade assembly retaining pin 55 (which could advantageously be a bolt & nut). A blade set is the combination of a tube blade 53 with its associated flighting blade 54.

Each blade set is constructed to be custom configured to the augers to be cleaned, taking into account the quality control tolerances of the manufacturer of the particular auger. This means that the blade set will fit an entire manufacturing line of that particular auger.

The stem and flighting blade assembly 50, 60, handles 12, 14, hinge plates 26, 28, blade assembly sockets 51, 61, blade assembly retaining pins or bolts 55, 65, and latch guide washers 40 are identical between the left and right half of the auger cleaner 10 except that one side is simply an inverted, or turned over, version of the other side. This lends to the ease of construction and quality control of the auger cleaner. This feature also allows the cleaner to clean the top and bottom of the flighting and the stem at two separate locations equally well regardless of rotation direction.

The tube and flighting blade set is removable and exchangeable between different auger cleaners or handle assemblies.

The stem or tube blades 53, 63 of the cleaner 10 are designed and constructed to peel the debris from the tube or stem, resulting in a very complete cleaning.

AN EXAMPLE

If a person is cleaning augers with an auger cleaner 10 fitted with a blade assembly for Central Mine Equipment 4¼" inside diameter hollow stem augers, the blade assembly retaining pin may be removed, and the blade assembly slid out from the blade holder socket. Then a blade assembly suitable for Mobile Drilling Company 2¼" inside diameter hollow stem augers may be installed, following the above steps in reverse order. That person is then ready to clean the Mobile auger as easily as the Central Mine Equipment augers.

A first alternate embodiment (not shown) of the present invention may be realized by making the device larger in dimensions to clean larger augers. According to this first alternate embodiment, larger diameter "heavier" wall pipe will be used to construct handles which will be identical in construction to the preferred embodiment, but will employ blades to clean hollow stem augers having inside diameters in a range of from about 4¼ inches to about 12¼ inches. The construction and appearance of the hinge assembly will be identical, for this first alternate embodiment, to that of other embodiments in all aspects other than physical size.

A second alternate embodiment (not shown) of the present invention may be realized by making the blade portions unitary with the handles. That is, the blade assemblies of the second alternate embodiment are not removable from the rest of the device.

A preferred embodiment of the invention has been described for purposes of illustration. Of course, various equivalent elements may be substituted for those described above without departing from the spirit of the invention. The embodiments described are not intended to be limiting, and the scope of the invention is limited only so far as the appended claims.

What is claimed is:

1. A device for cleaning a helical auger which has a central longitudinal axis, said device comprising:

means for engaging a working surface of the helical auger; and means for rotating said engaging means about the central longitudinal axis of the helical auger;

wherein said means for rotating includes:

two handles;

articulating means for connecting together said two handles so that the handles are articulated to be free to move in relation to one another; and means for selectively fastening said two handles together such that they are inhibited from moving relative to one another.

2. The device according to claim 1, wherein the means for engaging comprises a pair of opposed blades.

3. The device according to claim 1, wherein said articulating means comprises a hinge connected between said two handles.

4. The device according to claim 1, wherein the means for selectively fastening comprises a latch which is permanently rotatably connected to one of said two handles, and wherein said latch is selectively engagable with the other of said two handles.

5. A method for cleaning a helical auger which has a stem and a flighting, using a device as claimed in claim 1, said method comprising the steps of:

(a) bringing the means for engaging into a position of engagement with the auger; and (b) rotating the device around the auger;

wherein dirt or debris which may be adherent to the stem or flighting of the auger is removed.

6. An auger cleaner for use with a helical auger which has a stem and a flighting, said auger cleaner comprising:

a first support member;

a second support member, spaced apart from said first support member;

a first blade sized to fit between adjacent turns of the flighting of the auger, said first blade being disposed between said first support member and said second support member and being connected to one of said first support member and said second support member;

a rotational pivot, said first support member and said second support member being connected together by said rotational pivot, wherein said first support member and said second support member are rotatable with respect to one another so as to bring said first blade into engagement with the stem of the auger; and a latch which is permanently connected to said first support member and which is selectably connectable to said second support member, so that when said latch is connected to said second support member the support members are fastened together so as to prevent the support members from moving with respect to one another.

7. The auger cleaner according to claim 6, wherein said first support member has one or more extensions sized to be useable as handles.

8. The auger cleaner according to claim 6, wherein said second support member has one or more extensions sized to be useable as handles.

9. The auger cleaner according to claim 6, wherein said first blade is connected to said first support member, and wherein said auger cleaner further comprises:

a second blade sized to fit between adjacent turns of the flighting of the auger, said second blade being disposed between said first support member and said second support member and being connected to said second support member;

wherein said first support member and said second support member are rotatable with respect to one another so as to bring both said first blade and said second blade into engagement with the stem of the auger.

10. The auger cleaner according to claim 9, wherein said first blade and said second blade are directly opposed to one another and spaced apart from one another when said first support member and said second support member are fastened together by said latch.

11. The auger cleaner according to claim 10, wherein said first support member has one or more extensions sized to be useable as handles.

12. The auger cleaner according to claim 10, wherein said second support member has one or more extensions sized to be useable as handles.

13. The auger cleaner according to claim 9, wherein the stem of the auger is captured between said first blade and said second blade when the blades are brought into engagement with the stem.

14. The auger cleaner according to claim 9, wherein sale first blade and said second blade are both removable from the auger cleaner, so that they may be exchanged with other blades of different sizes.

15. An auger cleaner for use with a helical auger which has a stem and a flighting, said auger cleaner comprising:

a first handle, said first handle being elongated and cylindrical;

a second handle, said second handle being elongated and cylindrical, and being spaced apart from said first handle;

a first blade sized to fit between adjacent turns of the fighting of the auger, said first blade being disposed between said first handle and said second handle and being connected to said first handle;

a second blade sized to fit between adjacent turns of the flighting of the auger, said second blade being disposed between said first handle and said second handle and being connected to said second handle;

a hinge, said first handle and said second handle being connected together by said hinge, wherein said first handle and said second handle are rotatable with respect to one another so as to bring said first blade and said second blade into engagement with the stem of the auger; and a latch which is permanently, rotatably connected to said first handle and which is selectably connectable to said second handle, so that when said latch is connected to said second handle both handles are fastened together so as to prevent said handles from moving with respect to one another.

* * * * *